US009384664B2

(12) United States Patent
Torii et al.

(10) Patent No.: US 9,384,664 B2
(45) Date of Patent: Jul. 5, 2016

(54) PARKING ASSISTANCE DEVICE

(71) Applicants: AISIN SEIKI KABUSHIKI KAISHA, Kariya-shi (JP); HONDA MOTOR CO., LTD., Minato-ku (JP)

(72) Inventors: Masanori Torii, Kariya (JP); Jun Kadowaki, Kariya (JP); Hiroki Inagaki, Kariya (JP); Katsuhiro Sakai, Wako (JP)

(73) Assignees: AISIN SEIKI KABUSHIKI KAISHA, Kariya-Shi, Aichi (JP); HONDA MOTOR CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 14/502,258

(22) Filed: Sep. 30, 2014

(65) Prior Publication Data

US 2015/0097705 A1 Apr. 9, 2015

(30) Foreign Application Priority Data

Oct. 4, 2013 (JP) ..... 2013-209672

(51) Int. Cl.
*G08G 1/14* (2006.01)
*G08G 1/16* (2006.01)

(52) U.S. Cl.
CPC ..... *G08G 1/168* (2013.01)

(58) Field of Classification Search
CPC ..... G08G 1/168; G08G 1/165; G08G 1/166; B60R 1/00; B60R 2300/302; B60R 2300/305; B60R 2300/8026; B60R 2300/806; B60W 50/14; B62D 15/027; B62D 15/028; B62D 15/0285; B60L 11/1816; B60L 11/1818
USPC ..... 340/932.2, 435, 425.5, 988, 436, 936, 340/937, 938, 966, 987, 991–994, 995.17, 340/995.25, 995.28
See application file for complete search history.

(56) References Cited

U.S. PATENT DOCUMENTS

2003/0011177 A1 1/2003 Yasuhara et al.
2007/0146166 A1* 6/2007 Sato ..... B62D 15/028 340/932.2

(Continued)

FOREIGN PATENT DOCUMENTS

EP 2 093 129 A2 8/2009
JP 10-300770 A1 11/1998

(Continued)

OTHER PUBLICATIONS

Office Action issued on Sep. 1, 2015, by the Japanese Patent Office in corresponding Japanese Patent Application No. 2013-209672 (3 pages).

(Continued)

*Primary Examiner* — Daniel Previl
(74) *Attorney, Agent, or Firm* — Buchanan Ingersoll & Rooney PC

(57) ABSTRACT

Provided is a parking assistance device capable of setting a parking target position without placing a burden on a driver. The parking assistance device includes: a ground object detection unit configured to detect a ground object that defines a parking stall in a predetermined detection region set in advance on a lateral side of a vehicle; a parking stall calculation unit configured to, based on the ground object detected by the ground object detection unit, calculate a parking stall that exists in the detection region; and a target parking stall setting unit configured to, among the parking stalls calculated by the parking stall calculation unit, sets a parking stall in a width direction of the vehicle in a view from a driver's seat of the vehicle as a target parking stall.

17 Claims, 7 Drawing Sheets

(56) References Cited

U.S. PATENT DOCUMENTS

| | | | | |
|---|---|---|---|---|
| 2009/0174574 | A1* | 7/2009 | Endo | B60R 1/00 340/932.2 |
| 2009/0243888 | A1* | 10/2009 | Kawabata | G08G 1/166 340/932.2 |
| 2011/0004377 | A1* | 1/2011 | Harase | B60R 21/0136 701/45 |
| 2011/0224869 | A1 | 9/2011 | Inagaki | |
| 2012/0310484 | A1 | 12/2012 | Higuchi | |
| 2013/0162829 | A1 | 6/2013 | Kadowaki et al. | |
| 2015/0085129 | A1* | 3/2015 | Mihalyov | G07B 15/02 348/150 |

FOREIGN PATENT DOCUMENTS

| | | | |
|---|---|---|---|
| JP | 2003-025945 | A | 1/2003 |
| JP | 2005-178578 | A | 7/2005 |
| JP | 2008-100548 | A | 5/2008 |
| JP | 2009-196408 | A | 9/2009 |
| JP | 2010-15331 | A | 1/2010 |
| JP | 2011-039600 | A | 2/2011 |
| JP | 2011-183929 | A | 9/2011 |
| JP | 4788539 | B2 | 10/2011 |
| JP | 2012-17021 | A | 1/2012 |
| JP | 2012-245954 | A | 12/2012 |
| WO | 2007/122864 | A1 | 11/2007 |
| WO | 2008/059644 | A1 | 5/2008 |
| WO | 2012/043092 | A1 | 4/2012 |

OTHER PUBLICATIONS

Office Action (Notice of Reasons for Rejection) issued on Mar. 8, 2016, by the Japanese Patent Office in corresponding Japanese Patent Application No. 2013-209672 and Partial Translation. (4 pages).

* cited by examiner

PARKING ASSISTANCE DEVICE

CROSS REFERENCE TO RELATED APPLICATIONS

This application is based on and claims priority under 35 U.S.C. Section 119 to Japanese Patent Application No. 2013-209672 filed on Oct. 4, 2013, the entire content of which is incorporated herein by reference.

TECHNICAL FIELD

This disclosure relates to a parking assistance device configured to set a target parking stall in which a vehicle is to be parked.

BACKGROUND DISCUSSION

Conventionally, parking assistance devices that set a parking stall in which a vehicle is to perform garage parking have been used. JP 2011-39600A discloses an example of this type of technique.

The parking assistance device disclosed in JP 2011-39600A detects, from a region in the vehicle periphery, a target parking position for parking the same vehicle, and, according to the detection result, changes the method for displaying a frame image indicating the target parking position rendered in the image of the vehicle periphery. Specifically, a frame image is displayed at a default position, and if a target parking position is detected, the position of the frame image is changed from the default position.

SUMMARY

The parking assistance device disclosed in JP 2011-39600A displays an icon or a message to prompt the user to perform selection if multiple target parking positions are detected. In such a case, the user needs to perform an operation such as pressing the position of the frame image corresponding to the desired target parking position. Because of this, a burden is placed on the user.

In view of the foregoing problem, this disclosure provides a parking assistance device capable of setting a parking target position without placing a burden on a driver.

A characteristic configuration of a parking assistance device includes: a ground object detection unit configured to detect a ground object defining a parking stall in a predetermined detection region set in advance on a lateral side of a vehicle; a parking stall calculation unit configured to, based on the ground object detected by the ground object detection unit, calculate a parking stall that exists within the detection region; and a target parking stall setting unit configured to, among parking stalls calculated by the parking stall calculation unit, set a parking stall in a width direction of the vehicle as viewed from a driver's seat of the vehicle as a target parking stall.

DETAILED DESCRIPTION

Figure 1:
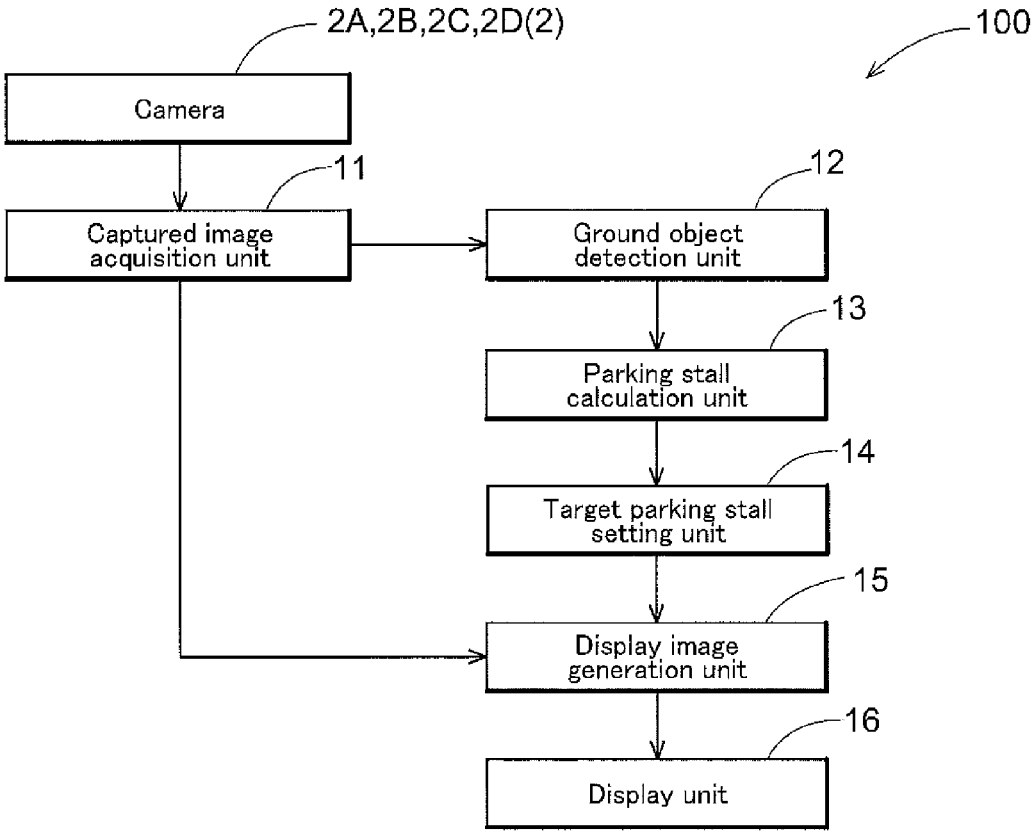
FIG. 1 is a schematic block diagram showing a configuration of a parking assistance device.

A parking assistance device according to this disclosure relates to a parking assistance device configured to automatically set a target parking stall in which a vehicle is to be parked. A parking assistance device 100 according to the present embodiment will be described in detail hereinafter.

A characteristic configuration of a parking assistance device according to this disclosure includes: a ground object detection unit configured to detect a ground object that defines a parking stall in a predetermined detection region set in advance on a lateral side of a vehicle; a parking stall calculation unit configured to, based on the ground object detected by the ground object detection unit, calculate a parking stall that exists within the detection region; and a target parking stall setting unit configured to, among parking stalls calculated by the parking stall calculation unit, set a parking stall in a width direction of the vehicle as viewed from a driver's seat of the vehicle as a target parking stall.

With this kind of characteristic configuration, it is possible to automatically set a parking stall at a position on the lateral side of the driver's seat as a target parking stall according to movement of the vehicle, without an operation of the driver. Accordingly, a parking stall that can be seen when the driver faces directly laterally can be set as the target parking stall and an operation by the driver is not needed, and therefore the driver can focus on driving the vehicle.

Also, when garage parking the vehicle, it is preferable that, among the parking stalls calculated by the parking stall calculation unit, the target parking stall setting unit sets a parking stall having a ground object on both sides in the width direction of the parking stall as the target parking stall.

Generally, in a parking area in which parking stalls are aligned, ground objects are arranged on both sides in the width direction of a parking stall, and the parking stall and the parking stalls adjacent to the parking stall are partitioned by the ground objects. Accordingly, with this configuration, false detection of ground objects can be prevented, and therefore the target parking stall can be set accurately.

Also, it is preferable that if no parking stall is present in the width direction of the vehicle in a view from the driver's seat, the target parking stall setting unit sets, as the target parking stall, the parking stall at a position having the shortest distance in the length direction of the vehicle from the width-direction position of the driver's seat of the vehicle.

Thus, if no parking stall is present at a position along the width direction of the vehicle in a view from the driver's seat, the parking stall at a position near the position along the width direction of the vehicle in a view from the driver's seat is set as the target parking stall, and thereby the amount of time needed for parking can be shortened. Also, a new target parking position can be set without placing a burden on a driver.

Also, it is preferable that if a plurality of parking stalls are present in the width direction of the vehicle as viewed from the driver's seat, the target parking stall setting unit sets, as the target parking stall, the parking stall located behind the vehicle in the vehicle length direction.

Generally, in the case of parking a vehicle in a parking stall, it is often the case that after the parking stall is specified, the vehicle travels forward a bit and enters the parking stall by traveling in reverse. For this reason, according to this configuration, it is possible to set, as the target parking stall, a parking stall at a position with a short subsequent forward travel distance and that is easy to back into.

Also, it is preferable that the target parking stall setting unit automatically re-sets the target parking stall according to movement of the detection region accompanying movement of the vehicle.

With this kind of configuration, if the driver does not like the target parking stall that was first set, by merely moving the vehicle, another target parking stall can be set automatically. Accordingly, no burden is placed on the driver of the vehicle to re-set the target parking stall, and therefore the driver can focus on driving.

FIG. 1 is a schematic block diagram showing a configuration of a parking assistance device 100 according to the present embodiment. As shown in FIG. 1, the parking assistance device 100 is configured to include functional units, namely a captured image acquisition unit 11, a ground object detection unit 12, a parking stall calculation unit 13, a target parking stall setting unit 14, a display image generation unit 15, and a display unit 16. The functional units use a CPU as a core member, and the above-mentioned functional units for performing various types of processing for automatically setting a target parking stall PP in which a vehicle 1 is to be parked are configured by hardware, software, or both. In the present embodiment, the parking assistance device 100 is included in a vehicle 1.

Figure 2:
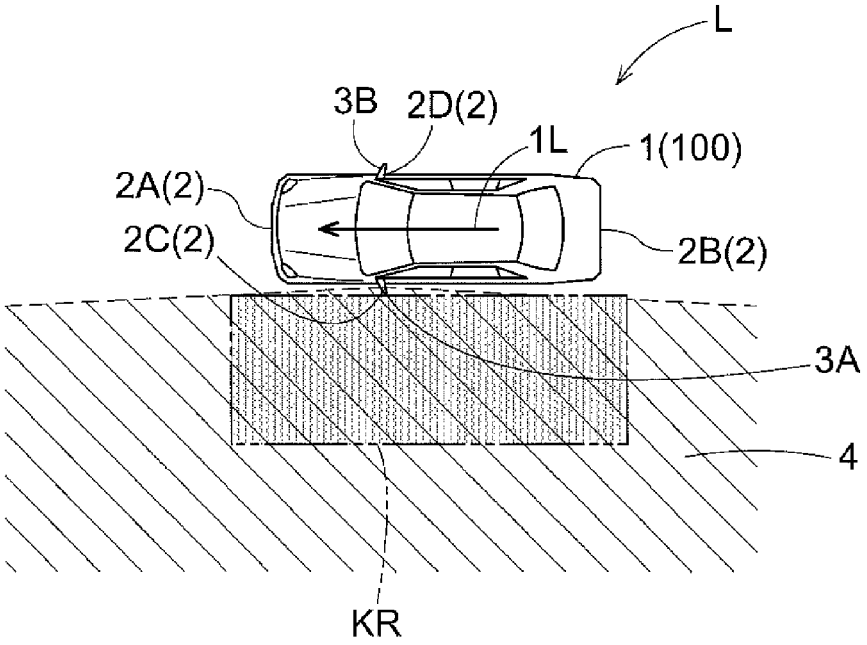
FIG. 2 is a diagram showing an example of an imaging range and a detection range.

The captured image acquisition unit 11 acquires a captured image of a view of the periphery of the vehicle 1. The periphery of the vehicle 1 is the front, back, left, and right of the vehicle 1. A captured image is acquired by cameras 2A to 2D included in the vehicle 1. For this reason, as shown in FIG. 2, the front camera 2A that acquires a captured image of the front of the vehicle 1 is provided in the central portion in the width direction of the front end portion of the vehicle 1, for example, and the camera 2B that acquires a captured image of the back of the vehicle 1 is provided in the central portion in the width direction of the back end portion of the vehicle 1, for example. Also, the camera 2C that acquires a captured image of the left of the vehicle 1 and the camera 2D that acquires a captured image of the right of the vehicle 1 are arranged respectively on left and right door mirrors 3A and 3B of the vehicle 1, for example. In the present embodiment, it is sufficient that the cameras 2C and 2D are provided on at least the left and right door mirrors 3A and 3B. Note that if it is not necessary to make any particular distinction between the respective cameras 2A to 2D below, they will be described as "camera 2". The captured image acquisition unit 11 acquires a captured image of a view of the periphery of the vehicle 1, captured by this kind of camera 2. The captured image acquired by the captured image acquisition unit 11 is transferred to the ground object detection unit 12 and the display image generation unit 15, which will be described later.

Figure 3:
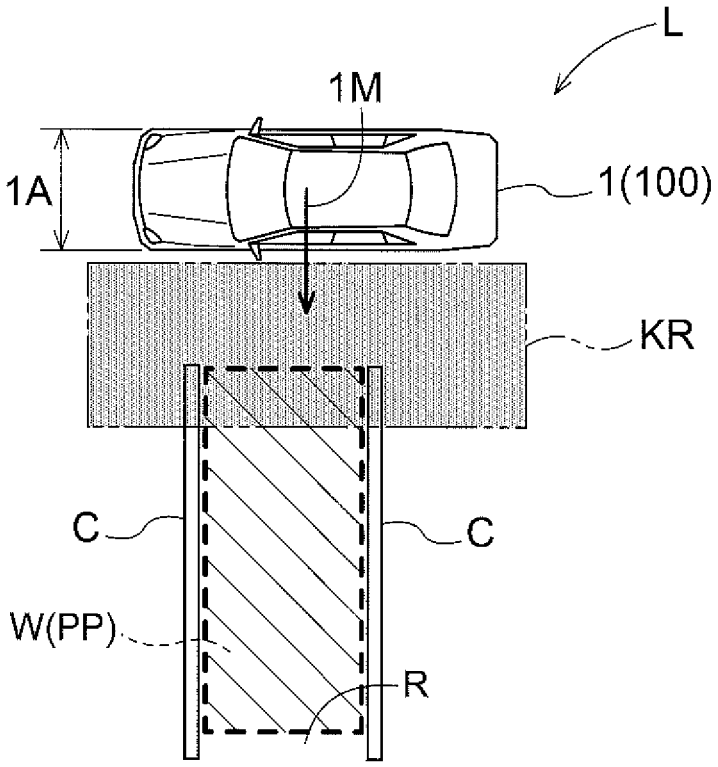
FIG. 3 is a diagram showing detection of a ground object and calculation of a parking stall.

The ground object detection unit 12 performs detection of a ground object C that defines a parking stall R in a predetermined detection region KR set in advance on a lateral side of the vehicle 1. The lateral sides of the vehicle 1 are the left side and right side of the vehicle 1. In the present embodiment, in order to simplify the description, a description is given using the left side of the vehicle 1 as an example of the lateral side of the vehicle 1. The detection region KR is included in the imaging range 4 of the camera 2C as shown in FIG. 2. In the present embodiment, the detection region KR is set along the vehicle length direction 1L of the vehicle 1 on the left side of the vehicle 1. In the present embodiment, the parking stall R is a stall having space in which the vehicle 1 can perform garage parking. The ground object C corresponds to a white line, a curbstone, a hedge, or the like that defines this kind of parking stall R. For this reason, the ground objects C that define the parking stall R correspond to a pair of ground objects C having a gap therebetween that is at least wider than the width 1A of the vehicle 1 as shown in FIG. 3. The ground object detection unit 12 performs image recognition with respect to the captured image transferred from the captured image acquisition unit 11 and thereby detects the ground objects C that define the parking stall R. Since the detection region KR also moves according to the traveling of the vehicle 1, the detection of the ground objects C is performed sequentially according to the traveling of the vehicle 1. The detection result of the ground object detection unit 12 is transferred to the parking stall calculation unit 13, which will be described later.

Based on the ground objects C detected by the ground object detection unit 12, the parking stall calculation unit 13 calculates the parking stall R that exists in the detection region KR. The ground objects C detected by the ground object detection unit 12 are a pair of ground objects C that were detected in the detection region KR set on the lateral side of the vehicle 1, and that have a gap therebetween that is at least wider than the width 1A of the vehicle 1. The parking stall calculation unit 13 calculates this kind of pair of ground objects C in the detection region KR. The result of the detection performed by the parking stall calculation unit 13 is transferred to the target parking stall setting unit 14, which will be described later.

Among the parking stalls R calculated by the parking stall calculation unit 13, the target parking stall setting unit 14 sets a parking stall R in the width direction 1M of the vehicle 1 in a view from the driver's seat of the vehicle 1 as the target parking stall PP. The parking stall R calculated by the parking stall calculation unit 13 is transferred from the parking stall calculation unit 13 as a detection result. The width direction 1M of the vehicle 1 in a view from the driver's seat of the vehicle 1 refers to the directly lateral direction in the case where a driver sits in the driver's seat of the vehicle 1 facing the forward traveling direction. Accordingly, the target parking stall setting unit 14 sets the parking stall R in the direction directly lateral to the driver as the target parking stall PP in which the vehicle 1 is to perform garage parking.

Here, in the present embodiment, garage parking of the vehicle 1 is explained using examples. As described above, the ground object C that defines the parking stall R in which garage parking of the vehicle 1 is possible corresponds to a white line, a curbstone, a hedge, or the like. This kind of ground object C is provided on both sides in the width direction of the parking stall R. Accordingly, in the present embodiment, among the parking stalls R calculated by the parking stall calculation unit 13, the target parking stall setting unit 14 sets a parking stall R having a ground object C on both sides in the width direction of the parking stall R as the target parking stall PP.

When this kind of target parking stall PP is set, it is indicated with the addition of a parking frame W on the display unit 16 serving as a monitor included in the vehicle 1, such that the fact that the target parking stall PP has been set and the position thereof are easy for the driver to recognize.

In order to indicate to the driver that there is enough space to park the vehicle 1, the parking frame W is shown according to the shape of the vehicle 1 in the image displayed on the display unit 16. Accordingly, the vehicle frame W is shown using a rectangular shape that is the shape of the vehicle 1. This kind of target parking stall PP that was set by the target parking stall setting unit 14 is transferred to the display image generation unit 15, which will be described later.

The display image generation unit 15 generates a display image that is to be displayed on the display unit 16 based on the captured image acquired by the captured image acquisition unit 11 and the target parking stall PP set by the target parking stall setting unit 14. The captured image acquired by the captured image acquisition unit 11 is used as-is as the display image by the display image generation unit 15. In the present embodiment, a view captured by the camera 2C on the side on which the target parking stall PP was set is displayed on the display unit 16 so that the position of the target parking stall PP set by the parking assistance device 100 is displayed to the driver of the vehicle 1. Accordingly, the display image generation unit 15 generates, as a display image, the captured image of the view that was captured by the camera 2C and acquired by the captured image acquisition unit 11. Note that the captured image of the view captured by the camera 2C may be displayed as-is by the display image generation unit 15, and it may be displayed on the display unit 16 with predetermined sites trimmed so as to match the image size.

The display image generation unit 15 displays the parking frame W such that it is superimposed on the captured image at the position of the target parking stall PP set by the target parking stall setting unit 14. Based on coordinates for the parking stall R calculated by the parking stall calculation unit 13, the parking frame W is displayed such that it is superimposed at a position corresponding to the coordinates in the captured image. This kind of display image generated by the display image generation unit 15 is transferred to the display unit 16, which will be described later.

The display unit 16 is a monitor provided in the vehicle 1 that displays the view from the vehicle 1 as well as the parking frame W defining the target parking stall PP of the above-described vehicle 1. By looking at the parking frame W displayed on the display unit 16, the driver can intuitively recognize the positional relationship between the target parking stall PP set by the parking assistance device 100 and the vehicle 1.

Here, in the present embodiment, the target parking stall setting unit 14 is configured to automatically re-set the target parking stall PP according to movement of the detection region KR accompanying movement of the vehicle 1. The detection region KR is set in advance at a predetermined position on the lateral side of the vehicle 1 as described above. For this reason, movement of the detection region KR accompanying movement of the vehicle 1 means that if the vehicle 1 moves, the detection region KR also moves along with it. In the present embodiment, the target parking stall PP is set based on the ground object C detected in the detection region KR. Accordingly, if the detection region KR moves accompanying movement of the vehicle 1, the ground object C that was detected in the detection region KR will move out of the detection region KR and will no longer be detected, and a ground object C that was outside of the detection region KR and was not detected will move into the detection region KR and will be detected, and the state in the detection region KR will change moment by moment according to the movement of the vehicle 1. Accordingly, the target parking stall setting unit 14 is configured to sequentially update the target parking stall PP automatically according to the current state of the detection region KR.

An example of a target parking stall PP that is re-set so as to match the traveling of the vehicle 1 will be described with reference to FIG. 4. First, as shown in (a) of FIG. 4 when a pair of ground objects C is detected in the detection region KR set on the lateral side of the vehicle 1, they are calculated as a parking stall R. Since the parking stall R is at a position along the width direction 1M of the driver's seat of the vehicle 1, it is set to be the target parking stall PP. In view of this, the parking frame W is displayed at that position.

Figure 4:
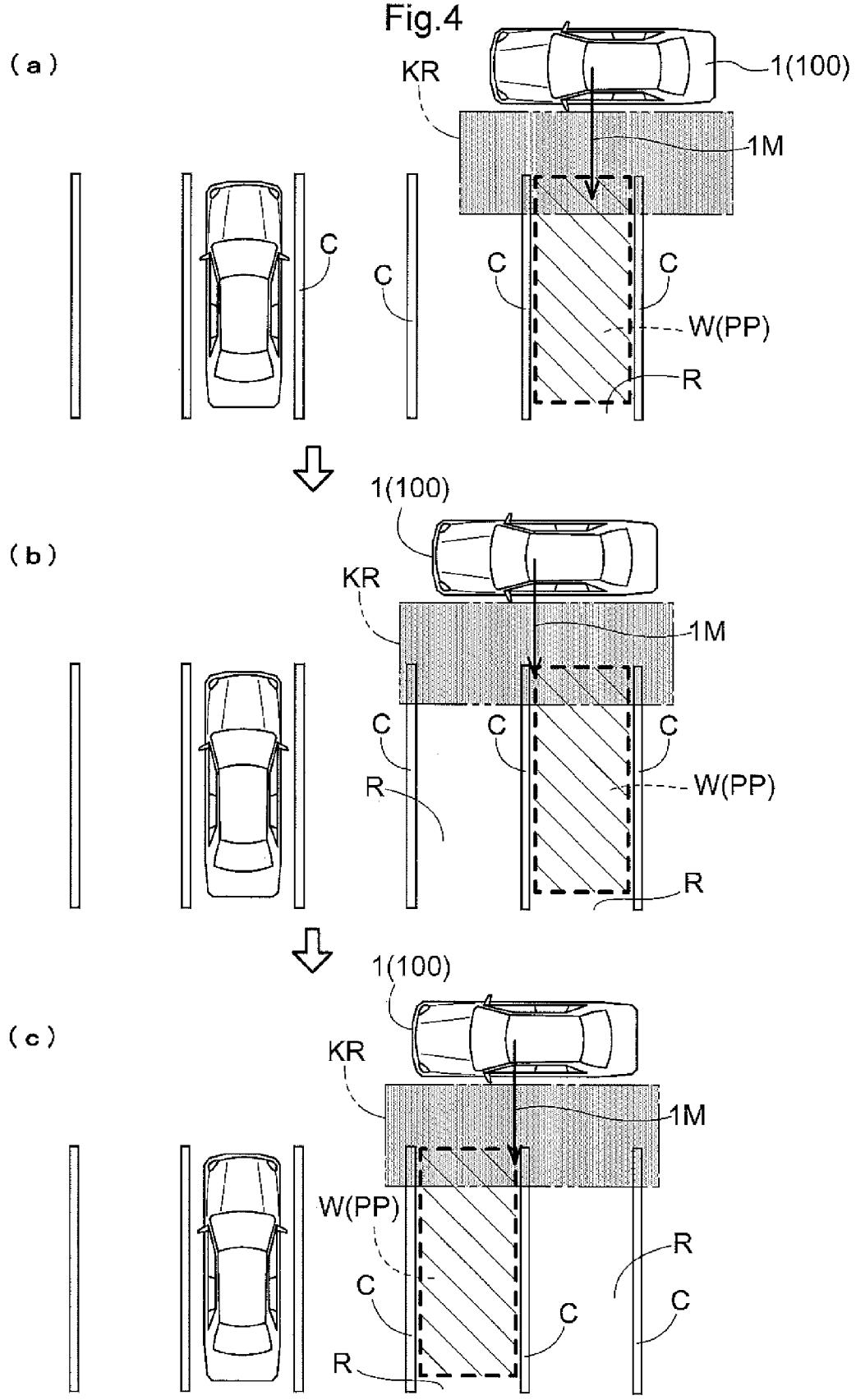
FIG. 4 is a diagram showing a target parking stall set by a parking assistance device.

On the other hand, if the vehicle 1 moves to a position shown in (b) of FIG. 4, the detection region KR also moves along with the vehicle 1. In this example, two pairs of ground objects C are detected in the detection region KR. For this reason, the two parking stalls R are calculated by the parking stall calculation unit 13. In this case as well, among the multiple (two) parking stalls R, the target parking stall setting unit 14 sets the parking stall R at a position along the width direction 1M of the driver's seat to be the target parking stall PP. Accordingly, the parking frame W is displayed at that position.

Furthermore, if the vehicle 1 moves to a position shown in (c) of FIG. 4, the detection region KR also moves along with the vehicle 1. In this example as well, two pairs of ground objects C are detected in the detection region KR. For this reason, the two parking stalls R are calculated by the parking stall calculation unit 13. In this case as well, among the multiple (two) parking stalls R, the target parking stall setting unit 14 sets the parking stall R at a position along the width direction 1M of the driver's seat to be the target parking stall PP. Accordingly, the parking frame W is displayed at that position.

Here, depending on a road L traveled by the vehicle 1, there are also cases in which there is no parking stall R in the width direction 1M of the vehicle 1 in a view from the driver's seat. In such a case, the target parking stall setting unit 14 sets, as the target parking stall PP, the parking stall R at the position having the shortest distance in the vehicle length direction 1L of the vehicle 1 from the position in the width direction 1M of driver's seat of the vehicle 1. Being at the position having the shortest distance in the vehicle length direction 1L of the vehicle 1 from the position in the width direction 1M of driver's seat of the vehicle 1 means, in a view of the front side in the proceeding direction and the rear side in the proceeding direction of the vehicle 1 from the position in the width direction 1M of the driver's seat of the vehicle 1, being at the position having the shortest distance from the position in the width direction 1M of the driver's seat. In a case where no parking stall R is present in the width direction 1M of the vehicle 1 in a view from the driver's seat, parking stalls R are calculated from the position in the width direction 1M of the driver's seat of the vehicle 1 to the front side in the proceeding direction and the back side in the proceeding direction of the vehicle 1, and among these, the target parking stall setting unit 14 sets the parking stall R having the shortest distance from the position in the width direction 1M of the driver's seat as the target parking stall PP.

Also, in a case where no parking stall R is present in the width direction 1M of the vehicle 1 in a view from the driver's seat, when parking stalls R are calculated from the position in the width direction 1M of the driver's seat of the vehicle 1 to only one of the front side in the proceeding direction and the back side in the proceeding direction of the vehicle 1, among the calculated parking stalls R, the target parking stall setting unit 14 sets the parking stall R having the shortest distance from the position in the width direction 1M of the driver's seat as the target parking stall PP.

Such an example will be described with reference to FIG. 5. First, as shown in (a) of FIG. 5, when a pair of ground objects C is detected in the detection region KR set on the lateral side of the vehicle 1, they are calculated as a parking stall R. Since the parking stall R is at a position along the width direction 1M of the driver's seat of the vehicle 1, it is set to be the target parking stall PP. In view of this, the parking frame W is displayed at that position.

Figure 5:
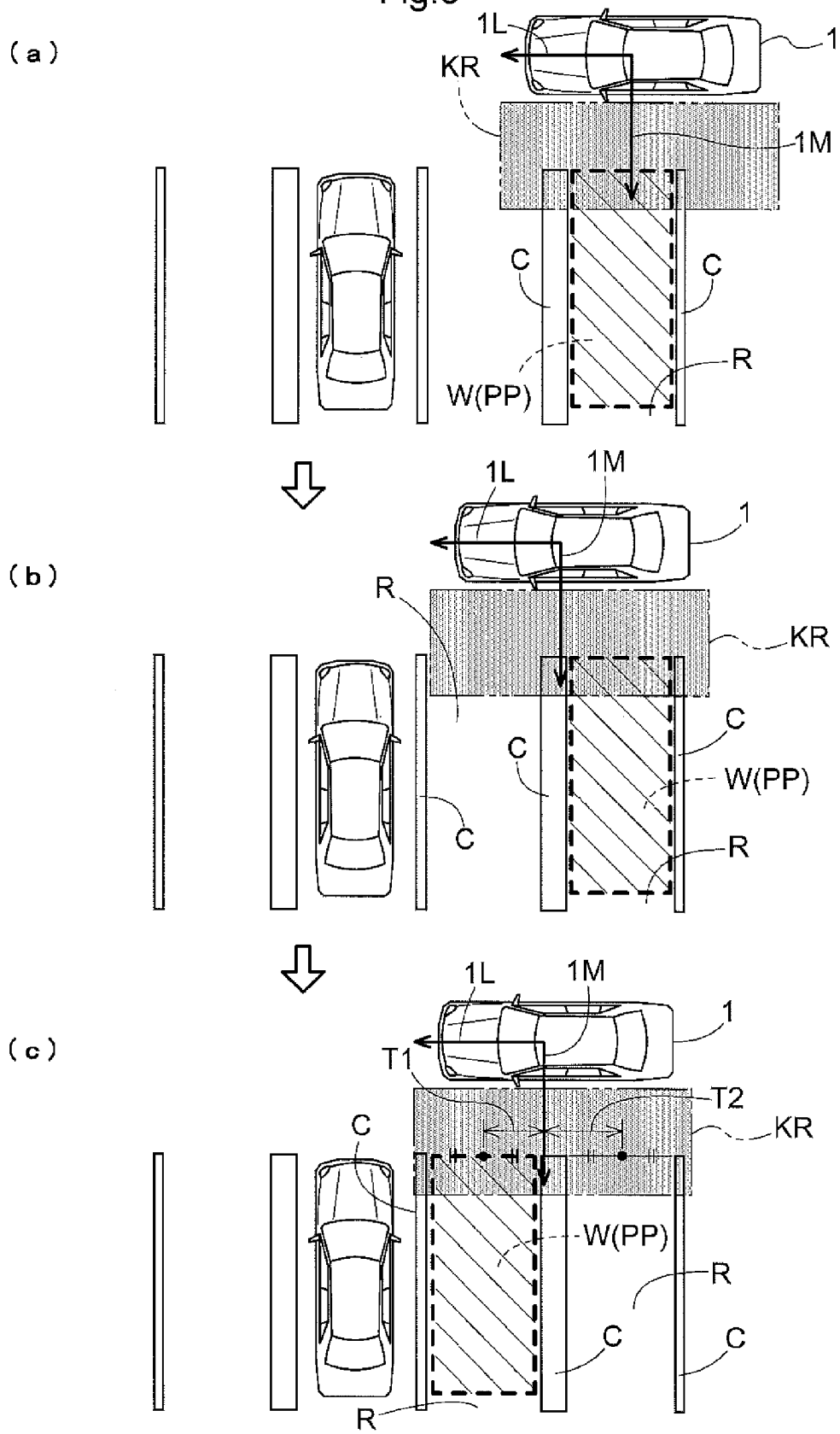
FIG. 5 is a diagram showing a target parking stall set by a parking assistance device.

On the other hand, if the vehicle 1 is moved to a position shown in (b) of FIG. 5, the detection region KR also moves along with the vehicle 1. In this example, a pair of ground objects C are detected in the detection region KR. For this reason, the parking stall R is calculated by the parking stall calculation unit 13. However, the calculated parking stall R is not located along the width direction 1M of the driver's seat, but rather a ground object C (e.g., a curbstone) is located along the width direction 1M of the driver's seat. In such a case, the target parking stall setting unit 14 sets the parking stall R that is the closest in a view from a position along the width direction 1M of the driver's seat as the target parking stall PP. Accordingly, the parking frame W is displayed at that position.

Furthermore, if the vehicle 1 moves to a position shown in (c) of FIG. 5, the detection region KR also moves along with the vehicle 1. In this example, two pairs of ground objects C are detected in the detection region KR. For this reason, two parking stalls R are calculated by the parking stall calculation unit 13. However, in the present example as well, no calculated parking stalls R are located along the width direction 1M of the driver's seat, and a ground object C (e.g., a curbstone) is located along the width direction 1M of the driver's seat. In such a case, the target parking stall setting unit 14 sets the parking stall R that is the closest in a view from a position along the width direction 1M of the driver's seat as the target parking stall PP.

Specifically, the target parking stall setting unit 14 compares a distance T1 to a parking stall R (the central portion in the width direction thereof) on the front side in the proceeding direction of the vehicle 1 in a view from a position along the width direction 1M of the driver's seat, and a distance T2 to a parking stall R (the central portion in the width direction thereof) on the back side in the proceeding direction of the vehicle 1 in a view from a position along the width direction 1M of the driver's seat, and sets the parking stall R on the front side in the proceeding direction corresponding to distance T1, which is the smaller of distance T1 and distance T2, as the target parking stall PP. Accordingly, the parking frame W is displayed at that position.

Figure 6:
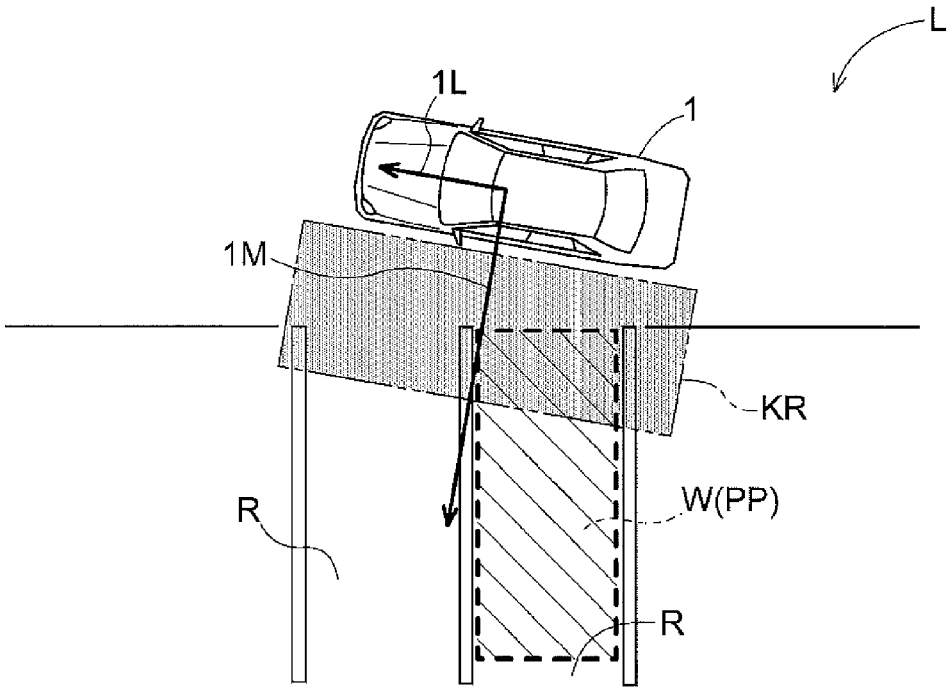
FIG. 6 is a diagram showing a target parking stall set by a parking assistance device.
Figure 7:
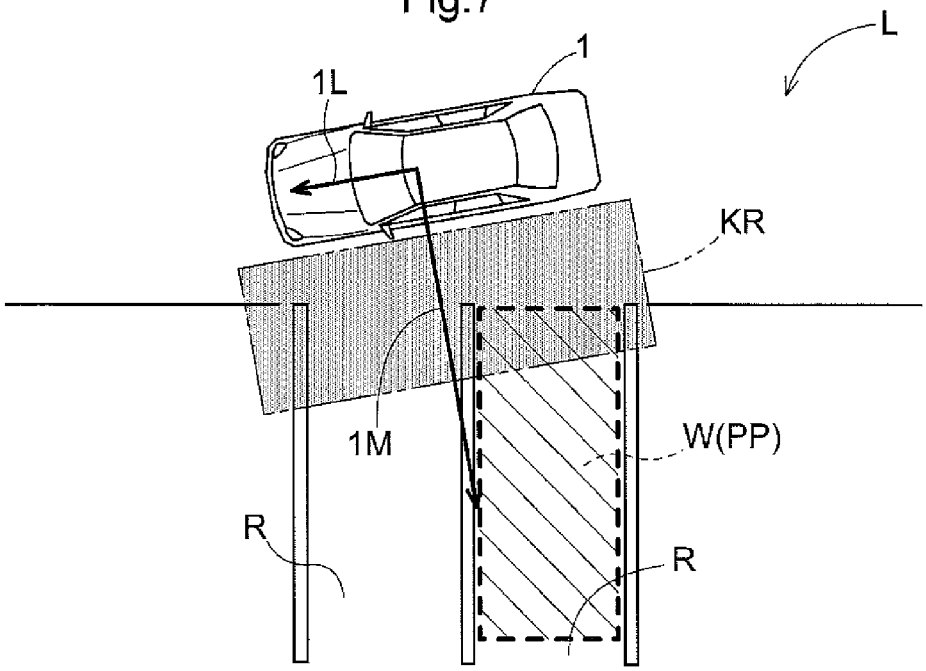
FIG. 7 is a diagram showing a target parking stall set by a parking assistance device.

Also, depending on the positional relationship between the vehicle 1 and the parking stall R, there are cases where multiple parking stalls R are present in the width direction 1M of the vehicle 1 in a view from the driver's seat. That is to say, as shown in FIGS. 6 and 7, in the case where parking stalls R are in a state of being provided so as to intersect the road L and the direction in which the road L extends is not parallel with the vehicle length direction 1L of the vehicle 1, two parking stalls R are sometimes calculated at positions along the width direction 1M of the driver's seat. In such a case, the target parking stall setting unit 14 sets the parking stall R on the back side in the vehicle length direction 1L of the vehicle 1 as the target parking stall PP. Being on the back side in the vehicle length direction 1L means being on the back side in the proceeding direction of the vehicle 1 from a position, among the parking stalls R that exist along the width direction 1M of the driver's seat of the vehicle 1. In the case where multiple parking stalls R are calculated at a position along the width direction 1M of the driver's seat, among the parking stalls R calculated along the position in the width direction 1M of the driver's seat of the vehicle 1, the target parking stall setting unit 14 sets the parking stall R that is more toward the back side in the proceeding direction of the vehicle 1 as the target parking stall PP. Accordingly, the parking frame W is displayed at that position.

Here, as described above, the target parking stall setting unit 14 is configured to automatically re-set the target parking stall PP according to movement of the detection region KR accompanying movement of the vehicle 1. For this reason, for example, also in the case where the driver wishes to set the target parking stall PP to a frontward parking stall R after the target parking stall setting unit 14 has set the target parking stall PP, the driver causes the vehicle 1 to travel forward, and thereby the parking stall R on the back side in the proceeding direction of the vehicle 1 is removed from the detection region KR and only the parking stall R on the front side in the proceeding direction of the vehicle 1 exists in the detection region KR, and thus it is possible to re-set the target parking stall PP in the correct position.

Figure 8:
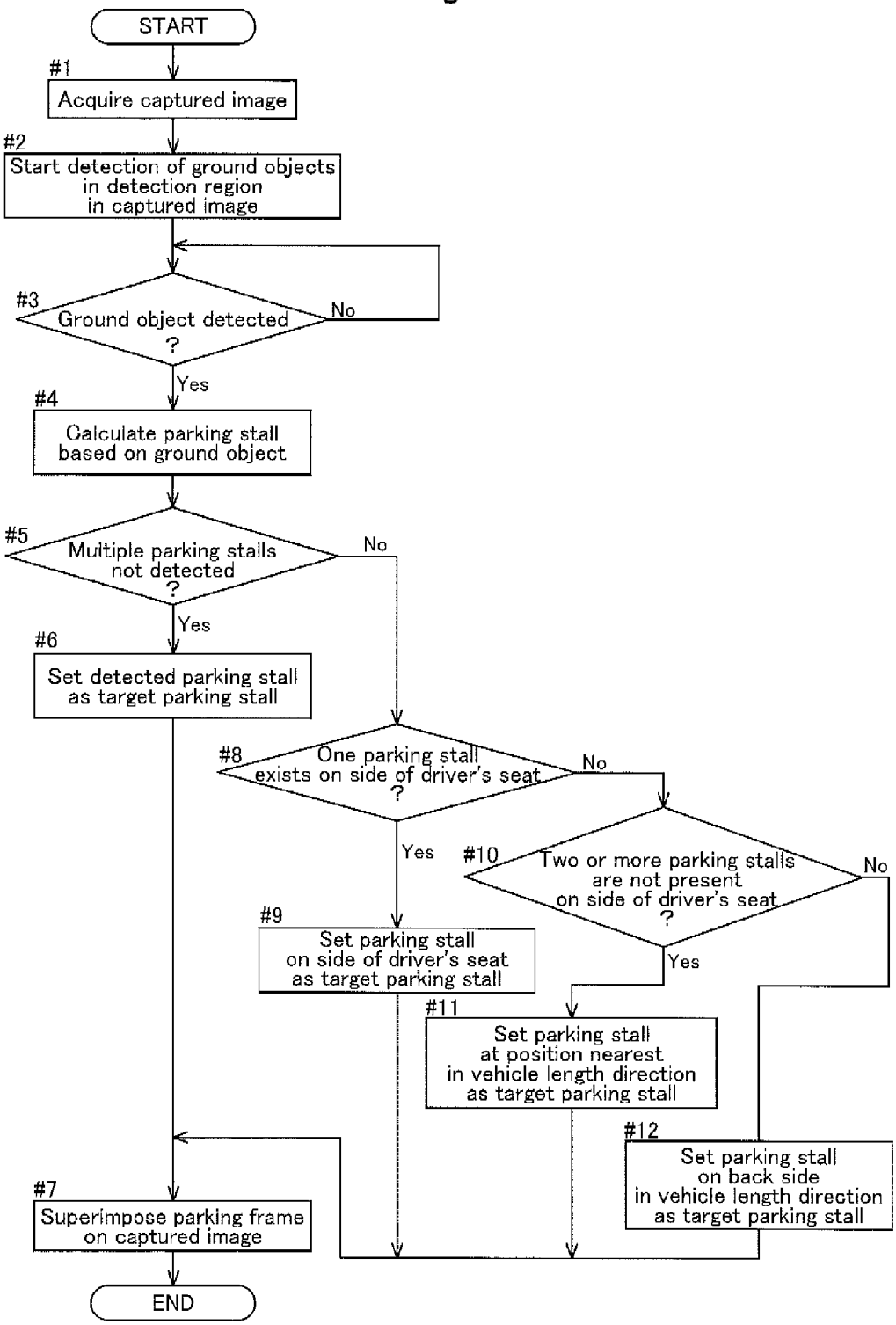
FIG. 8 is flowchart showing processing performed by a parking assistance device.

Next, processing performed by the parking assistance device 100 will be described with reference to the flowchart in FIG. 8. First, the captured image acquisition unit 11 acquires a captured image of a view of the periphery of the vehicle 1, captured by the camera 2 (step #1). Based on the captured image, the ground object detection unit 12 starts detection of a ground object C in the detection region KP in the captured image (step #2). If a pair of ground objects C that exist along the proceeding direction of the vehicle 1 are detected (Yes in step #3), the parking stall calculation unit 13 calculates a parking stall R based on the detected ground objects C (step #4).

If only one parking stall R is detected in the detection region KR by the parking stall calculation unit 13 (Yes in step #5), the target parking stall setting unit 14 sets that parking stall R as the target parking stall PP (step #6). The display image generation unit 15 superimposes a parking frame W on the captured image acquired by the captured image acquisition unit 11 at the position of the target parking stall PP and the captured image and the parking frame W are displayed on the display unit 16 (step #7).

If multiple parking stalls R were detected in the detection region KR in step #5 by the parking stall calculation unit 13 (No in step #5), but there is only one parking stall R in the width direction 1M of the driver's seat (Yes in step #8), the parking stall R along the width direction 1M of the driver's seat is set as the target parking stall PP (step #9). Then, as described above, the display image generation unit 15 superimposes a parking frame W on the captured image acquired by the captured image acquisition unit 11 at the position of the target parking stall PP and the captured image and the parking frame W are displayed on the display unit 16 (step #7).

If, in step #8, there are multiple parking stalls R in the width direction 1M of the driver's seat (No in step #8) and there are not multiple parking stalls R along the width direction 1M of the driver's seat (Yes in step #10), the parking stall R at the position having the shortest distance in the vehicle length direction 1L of the vehicle 1 is set as the target parking stall PP (step #11). Then, as described above, the display image generation unit 15 superimposes a parking frame W on the captured image acquired by the captured image acquisition unit 11 at the position of the target parking stall PP and the captured image and the parking frame W are displayed on the display unit 16 (step #7).

In step #10, if there are multiple parking stalls R in the width direction 1M of the driver's seat (No in step #10), the parking stall R on the back side in the vehicle length direction 1L of the vehicle 1 is set as the target parking stall PP (step #12). Then, as described above, the display image generation unit 15 superimposes a parking frame W on the captured image acquired by the captured image acquisition unit 11 at the position of the target parking stall PP and the captured image and the parking frame W are displayed on the display unit 16 (step #7). This processing is performed continuously along with the movement of the vehicle 1 until the vehicle 1 is parked in the target parking stall PP defined by the parking frame W.

ALTERNATIVE EMBODIMENTS

In the above-described embodiment, a description was given using an example in which the detection region KR is set on only the left side of the vehicle 1. However, the range of application of the parking assistance device 100 of this disclosure is not limited to this. It is also possible to use a configuration in which the detection region KR is set on the right side of the vehicle 1, and it is natural that it is also possible to use a configuration in which the detection region KR is set on the left and right sides of the vehicle 1.

In the present embodiment, a description was given using an example of a target parking stall PP in which the vehicle 1 performs garage parking. However, the range of application of the parking assistance device 100 of this disclosure is not limited to this. It is also natural that the present invention can be applied to setting a target parking stall PP in which the vehicle 1 is parallel parked.

In the present embodiment, it was described that, among the parking stalls R calculated by the parking stall calculation unit 13, the target parking stall setting unit 14 sets a parking stall R having a ground object C on both sides in the width direction of the parking stall R as the target parking stall PP. However, the range of application of the parking assistance device 100 of this disclosure is not limited to this. It is natural that, among the parking stalls R calculated by the parking stall calculation unit 13, the target parking stall setting unit 14 can set a parking stall R in which ground objects C are not present on both sides in the width direction of the parking stall R as the target parking stall PP. In such a case, if a parking stall R arranged along the width direction 1M of the driver's seat as in the above-described embodiment, a parking stall R located nearby along the width direction 1M of the driver's seat, or multiple parking stalls R along the width direction 1M of the driver's seat are present, it is preferable that the parking stall R located on the back side in the proceeding direction of the vehicle 1 is set as the target parking stall PP.

In the above-described embodiment, a description was given in which, in the case where no parking stall R is present in the width direction 1M of the vehicle 1 in a view from the driver's seat, the target parking stall setting unit 14 sets the parking stall R at a position having the shortest distance in the vehicle length direction 1L of the vehicle 1 from the position in the width direction 1M of the driver's seat of the vehicle 1 as the target parking stall PP. However, the range of application of the parking assistance device 100 of this disclosure is not limited to this. In the case where no parking stall R is present in the width direction 1M of the vehicle 1 in a view from the driver's seat, it is also possible for the target parking stall setting unit 14 to set the parking stall R at a position having the farthest distance in the vehicle length direction 1L of the vehicle 1 from the position in the width direction 1M of the driver's seat of the vehicle 1 as the target parking stall PP.

In the above-described embodiment, a description was given in which, in the case where multiple parking stalls R are present in the width direction 1M of the vehicle 1 in a view from the driver's seat, the target parking stall setting unit 14 sets the parking stall R on the back side in the vehicle length direction 1L of the vehicle 1 as the target parking stall PP. However, the range of application of the parking assistance device 100 of this disclosure is not limited to this. In the case where multiple parking stalls R are present in the width direction 1M of the vehicle 1 in a view from the driver's seat, it is also possible for the target parking stall setting unit 14 to set the parking stall R on the front side in the vehicle length direction 1L of the vehicle 1 as the target parking stall PP.

In the above-described embodiment, a description was given in which the target parking stall setting unit 14 automatically re-sets the target parking stall PP according to movement of the detection region KR accompanying movement of the vehicle 1. However, the range of application of the parking assistance device 100 of this disclosure is not limited to this. It is also possible for the target parking stall setting unit 14 to be configured to not automatically re-set the target parking stall PP, even if the vehicle 1 moves. In such a case, it is preferable that the target parking stall setting unit 14 is configured to set the target parking stall PP according to an instruction from the driver, for example.

Figure 9:
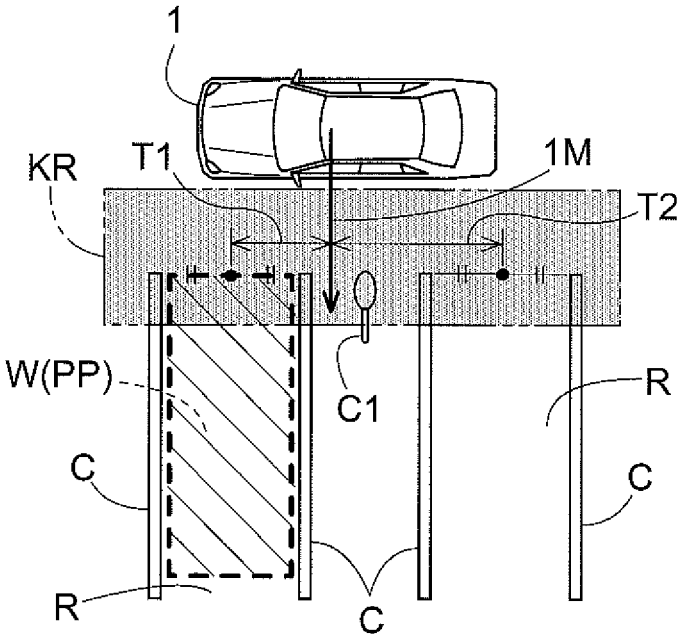
FIG. 9 is a diagram showing a target parking stall set by a parking assistance device according to another embodiment.

In the above-described embodiment, a description is given in which, in the case where no parking stall R calculated at a position along the width direction 1M of the driver's seat is present and ground objects C (e.g., curbstones) are present at a position along the width direction 1M of the driver's seat, the target parking stall setting unit 14 sets the parking stall R at the shortest distance in a view from a position along the width direction 1M of the driver's seat as the target parking stall PP. As shown in FIG. 9, even in the case where no parking stall R is present at a position along the width direction 1M of the driver's seat and, for example, an installed object (e.g., a street lamp illuminating a parking area) C1 installed in the parking area is present at a position along the width direction 1M of the driver's seat, according to the parking assistance device 100 of this disclosure, it is possible for the target parking stall setting unit 14 to set the parking stall R at the shortest distance in a view from a position along the width direction 1M of the driver's seat as the target parking stall PP.

This disclosure can be used for a parking assistance device configured to set a target parking stall in which a vehicle is to be parked.

What is claimed is:

1. A parking assistance device comprising:

a ground object detection unit configured to detect a ground object that defines a parking stall in a predetermined detection region set in advance on a lateral side of a vehicle;

a parking stall calculation unit configured to, based on the ground object detected by the ground object detection unit, calculate a parking stall that exists in the detection region; and a target parking stall setting unit configured to, among a plurality of adjacent parking stalls calculated by the parking stall calculation unit, set a parking stall in a width direction of the vehicle in a view from a driver's seat of the vehicle as a target parking stall.

2. A parking assistance device according to claim 1, wherein when garage parking the vehicle, among the parking stalls calculated by the parking stall calculation unit, the target parking stall setting unit sets a parking stall in which the ground object is present on both sides in the width direction of the parking stall as the target parking stall.

3. A parking assistance device according to claim 2, wherein if no parking stall is present in the width direction of the vehicle in a view from the driver's seat, the target parking stall setting unit sets, as the target parking stall, the parking stall at a position having the shortest distance in the length direction of the vehicle from the width-direction position of the driver's seat of the vehicle.

4. A parking assistance device according to claim 3, wherein if a plurality of parking stalls are present in the width direction of the vehicle as viewed from the driver's seat, the target parking stall setting unit sets, as the target parking stall, the parking stall located behind the vehicle in the vehicle length direction.

5. A parking assistance device according to claim 4, wherein the target parking stall setting unit automatically re-sets the target parking stall according to movement of the detection region accompanying movement of the vehicle.

6. A parking assistance device according to claim 3, wherein the target parking stall setting unit automatically re-sets the target parking stall according to movement of the detection region accompanying movement of the vehicle.

7. A parking assistance device according to claim 2, wherein if a plurality of parking stalls are present in the width direction of the vehicle as viewed from the driver's seat, the target parking stall setting unit sets, as the target parking stall, the parking stall located behind the vehicle in the vehicle length direction.

8. A parking assistance device according to claim 7, wherein the target parking stall setting unit automatically re-sets the target parking stall according to movement of the detection region accompanying movement of the vehicle.

9. A parking assistance device according to claim 2, wherein the target parking stall setting unit automatically re-sets the target parking stall according to movement of the detection region accompanying movement of the vehicle.

10. A parking assistance device according to claim 1, wherein if no parking stall is present in the width direction of the vehicle in a view from the driver's seat, the target parking stall setting unit sets, as the target parking stall, the parking stall at a position having the shortest distance in the length direction of the vehicle from the width-direction position of the driver's seat of the vehicle.

11. A parking assistance device according to claim 10, wherein if a plurality of parking stalls are present in the width direction of the vehicle as viewed from the driver's seat, the target parking stall setting unit sets, as the target parking stall, the parking stall located behind the vehicle in the vehicle length direction.

12. A parking assistance device according to claim 11, wherein the target parking stall setting unit automatically re-sets the target parking stall according to movement of the detection region accompanying movement of the vehicle.

13. A parking assistance device according to claim 10, wherein the target parking stall setting unit automatically re-sets the target parking stall according to movement of the detection region accompanying movement of the vehicle.

14. A parking assistance device according to claim 1, wherein if a plurality of parking stalls are present in the width direction of the vehicle as viewed from the driver's seat, the target parking stall setting unit sets, as the target parking stall, the parking stall located behind the vehicle in the vehicle length direction.

15. A parking assistance device according to claim 14, wherein the target parking stall setting unit automatically re-sets the target parking stall according to movement of the detection region accompanying movement of the vehicle.

16. A parking assistance device according to claim 1, wherein the target parking stall setting unit automatically re-sets the target parking stall according to movement of the detection region accompanying movement of the vehicle.

17. The parking assistance device according to claim 1, wherein the target parking stall setting unit sets, from among the parking stalls calculated by the parking stall calculation unit, a parking stall in which the ground object is present on both sides in the width direction of the parking stall as the target parking stall, and when the ground object is present in the width direction of the vehicle in a view from the driver's seat, the target parking stall setting unit sets, as the target parking stall, a parking stall at a position having the shortest distance in the length direction of the vehicle from the width-direction position of the driver's seat of the vehicle.

* * * * *